US007816307B2

(12) United States Patent
Braillard et al.

(10) Patent No.: US 7,816,307 B2
(45) Date of Patent: Oct. 19, 2010

(54) POWDER MIXTURE SUITABLE FOR SINTERING TO FORM A SELF-LUBRICATING SOLID MATERIAL

(75) Inventors: Frederic Braillard, Chatellerault (FR); Christelle Foucher, Acigne (FR); Philippe Perruchaut, Pau (FR)

(73) Assignees: SNECMA, Paris (FR); SNECMA Services, Paris (FR)

( * ) Notice: Subject to any disclaimer, the term of this patent is extended or adjusted under 35 U.S.C. 154(b) by 970 days.

(21) Appl. No.: 11/329,034

(22) Filed: Jan. 11, 2006

(65) Prior Publication Data

US 2006/0150768 A1 Jul. 13, 2006

(30) Foreign Application Priority Data

Jan. 12, 2005 (FR) ..... 05 00287

(51) Int. Cl.
*C10M 103/06* (2006.01)
*B22F 1/00* (2006.01)

(52) U.S. Cl. ..... 508/165; 508/167; 75/252; 419/10; 419/37

(58) Field of Classification Search ..... 508/103, 508/108

See application file for complete search history.

(56) References Cited

U.S. PATENT DOCUMENTS 2,964,476 A 12/1960 Coad
3,678,145 A 7/1972 Boes
3,956,146 A 5/1976 Tsuya et al.
5,808,214 A * 9/1998 Kaneko et al. ..... 75/246
6,123,748 A * 9/2000 Whitaker et al. ..... 75/252
6,245,718 B1 6/2001 Romanov et al.

FOREIGN PATENT DOCUMENTS

| | | |
|---|---|---|
| EP | 0 769 562 A1 | 4/1997 |
| FR | 1 080 017 | 12/1954 |
| JP | 58-133346 | 8/1983 |
| JP | 58-133347 | 8/1983 |
| SU | 433231 | 12/1974 |

* cited by examiner

*Primary Examiner*—Glenn A Caldarola
*Assistant Examiner*—Taiwo Oladapo
(74) *Attorney, Agent, or Firm*—Oblon, Spivak, McClelland, Maier & Neustadt, L.L.P.

(57) ABSTRACT

The invention relates to a novel self-lubricating solid material; to a method of preparing such a material from a powder mixture; to said powder mixture; and to mechanical parts made of said novel material. Said powder mixture comprises a powder of a metal alloy that is a precursor for the matrix of said material, particles of a first solid lubricant such as $CeF_3$ that are for insertion in said matrix without reacting with said metal alloy, and particles of a second solid lubricant such as $WS_2$ or $MoS_2$ for reacting with a component of said metal alloy during sintering of the powder to form a lubricating phase. Said material can be used for fabricating a bushing that is to receive a root of a variable-pitch vane of an airplane turbojet compressor.

18 Claims, 1 Drawing Sheet

POWDER MIXTURE SUITABLE FOR SINTERING TO FORM A SELF-LUBRICATING SOLID MATERIAL

The invention relates to a novel self-lubricating solid material; to a method of preparing such a material from a powder mixture; to said powder mixture; and to mechanical parts made of this novel material.

BACKGROUND OF THE INVENTION

Solid materials that are self-lubricating when dry are commonly used to fabricate mechanical parts such as bushings, ball joints, or pivots, that are subjected to high levels of friction even though their operating conditions make it impossible to use liquid lubricants of the oil or grease type. This applies in particular to the bushings used for protecting the roots of variable-pitch vanes in the compressors of airplane turbojets.

These bushings are generally mounted as tight fits in orifices formed through the stator casing of the compressor. They receive the roots of the variable-pitch vanes of the compressor. An example of this type of bushing is described in the US patent published under the U.S. Pat. No. 6,480,960 B2.

Such bushing and blade-root assemblies are subjected to large amounts of friction associated with the blades pivoting inside the bushings, or with the vibration caused by the operation of the turbojet. The bushings are made of a material that is "softer" than the material used for the pivots so that it is the bushings that wear as a priority, thereby protecting the pivots.

In order to limit the wear of said bushings (and thus the frequency with which they need to be replaced), it is advantageous to reduce friction at the contacting surfaces between the bushings and the vane pivots. That is why such bushings are made of a self-lubricating solid material, by sintering an intimate mixture of powders.

Such a mixture generally comprises a powder of a metal alloy, acting as a precursor for the matrix of the self-lubricating material, together with particles of a solid lubricant that are stable at the temperatures at which the material is worked and used so that they do not react with said metal alloy and remain intact in order to be capable of performing their lubricating action. Naturally, the greater the content of such particles in the mixture, the better are the self-lubricating properties of the final material (where the term "final material" is used to mean the material made from said powder mixture).

Nevertheless, the Applicant company has found that beyond a certain content level of this type of solid lubricant in the intimate mixture, evaluated as being 10% by volume, problems of densification appear, and the powder mixture becomes more difficult to sinter. In practice, it becomes necessary to increase the temperature and the duration of sintering or to use more complex pressing techniques, such as hot isostatic pressing, in order to be able to densify the powder mixture, thereby leading to an increase in the cost price of the fabricated parts. In any event, the final material presents a high degree of porosity and its mechanical properties suffer accordingly.

Furthermore, beyond a limiting content of lubricant, evaluated at 15% by volume, it is generally found that it becomes very difficult, if not impossible, to sinter the powder mixture.

OBJECTS AND SUMMARY OF THE INVENTION

An object of the present invention is to propose a powder mixture that can be sintered easily and that makes it possible to make a material that presents good self-lubricating properties.

To achieve this object, in a first aspect, the invention provides a powder mixture suitable for sintering to form a self-lubricating solid material, the mixture comprising a powder of a metal alloy that is a precursor for the matrix of said self-lubricating solid material, particles of cerium trifluoride $CeF_3$ as a first solid lubricant for insertion in said matrix without reacting with said metal alloy during sintering of the powder, and particles of a second solid lubricant for reacting with a component of said metal alloy during sintering of the powder in order to form a lubricating phase.

The invention thus resides in using two types of solid lubricant, having different modes of integration in the matrix of the final material. Because of this difference, it is found that a mixture comprising x % of the first solid lubricant and y % of the second solid lubricant is easier to sinter than a mixture comprising one only of the two types of lubricant at a content of (x+y)%.

Advantageously, in order to make said mixture easier to sinter, the content of the first solid lubricant in the mixture is equal to or less than about 15% by volume, and is preferably equal to or less than about 10% by volume. Similarly, the content of the second solid lubricant in said mixture is equal to or less than about 15% by volume, and preferably is equal to or less than about 10% by volume.

More advantageously, in order to obtain good self-lubricating properties in the final material, the sum of the contents of the first and second solid lubricants is greater than 10% by volume, and is preferably greater than 15% by volume.

It can thus be advantageous to select the contents of the first and second solid lubricants so that each lies in the range 5% to 10% by volume, with the sum of said contents being greater than 10% by volume, or even greater than 15% by volume.

In a second aspect, the invention provides a method of preparing a self-lubricating solid material, the method comprising the steps consisting in: making a mixture of powders of the type described above in accordance with the first aspect; mixing said mixture intimately (i.e. ensuring that the mixture is thoroughly uniform); and sintering the resulting intimate mixture.

Advantageously, in order to make it easier for the particles of the powder mixture to agglomerate, a binder is added to said intimate mixture.

The intimate mixture made in this way can then be molded by pressing or injection in a mold in such a manner as to form a blank for the part that is to be fabricated. The blank is then extracted from the mold and the binder removed in conventional manner during a catalytic or thermal binder-removing step, and said blank is finally densified by sintering. The method enables parts of very complex shape to be mass-produced from the powder mixture of the invention, and thus enables the cost price of said parts to be reduced.

In a third aspect, the invention provides a self-lubricating solid material comprising a metal alloy matrix and particles of a solid lubricant inserted in said matrix, the material further comprising a lubricating phase comprising a sulfur compound of hexagonal structure.

In a fourth aspect, the invention provides a mechanical part, said part being made of a material of the type described above, in accordance with the third aspect.

Advantageously, the mechanical part is a bushing for receiving the root of a variable-pitch compressor vane in an airplane turbojet.

BRIEF DESCRIPTION OF THE DRAWING

The invention and its advantages can be better understood on reading the following detailed description. The description refers to accompanying FIGS. 1 and 2 which respectively show first and second types of assembly comprising a bushing for a turbojet compressor vane.

MORE DETAILED DESCRIPTION

Figure 1:
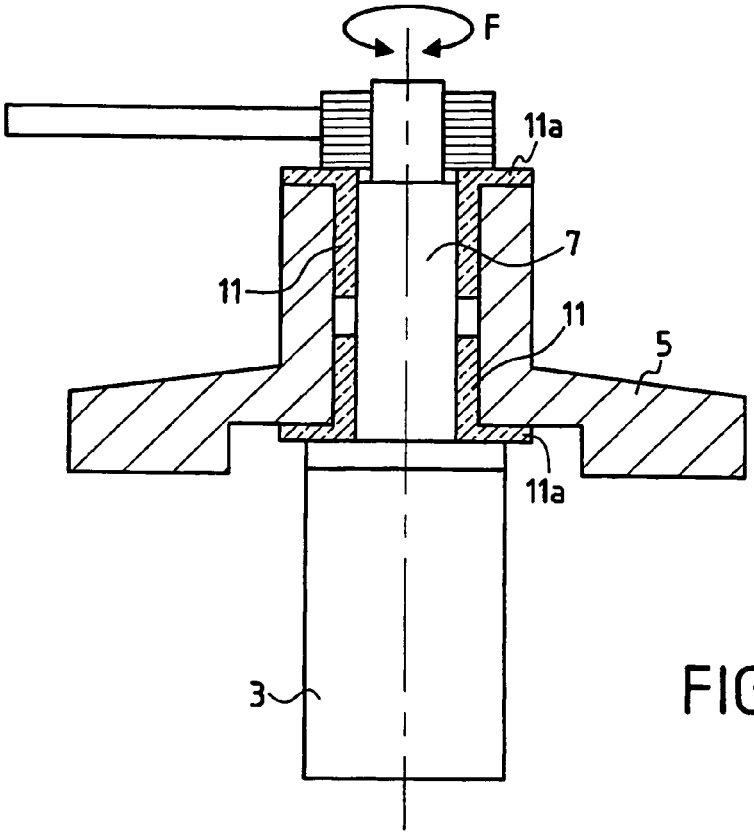

In a first aspect of the powder mixture of the invention, the metal alloy that constitutes a precursor for the matrix of the final self-lubricating solid material can be selected to be an alloy based on iron, nickel, or cobalt. By way of example, mention can be made of a nickel-based alloy of the Astroloy® (registered trademark) type and more particularly of a grade including 17.3% cobalt, 14.3% chromium, 4% aluminum, and 3.5% titanium. By way of example, mention can also be made of an iron-based alloy such as an alloy of the TY355® (registered trademark) type including 1.23% carbon, 4.05% vanadium, 4.68% chromium, 4.45% molybdenum, and 5.46% tungsten. These two example alloys are selected for their ability to withstand oxidation at high temperatures and for their mechanical properties, in particular hardness greater than 400 on the Vickers' hardness scale (HV).

In a second aspect of the powder mixture of the invention, the first solid lubricant can be selected as cerium trifluoride $CeF_3$. $CeF_3$ is a byproduct of rare earths that presents good wear behavior, in particular because of its lamellar hexagonal structure. In addition, $CeF_3$ presents good performance at high temperatures, up to 1000° C., thus making the powder mixture (or the self-lubricating solid material made from said mixture) particularly suitable for use in making mechanical parts that are subjected to high temperatures in operation, such as the bushings for turbojet compressor vanes.

In order to ensure that the particles of the first solid lubricant are easily inserted in the metal matrix of the final material, the mean size for the particles of the first solid lubricant is selected as a function of the mean size of the particles of the metal alloy.

In order to enable the powder mixture to be capable of being molded by pressing or injection in a mold, the mean size of the metal alloy particles preferably lies in the range 5 micrometers (μm) to 100 μm. Under such circumstances, the mean size for the particles of the first solid lubricant is selected to be less than 50 μm, so as to enable the particles of the first solid lubricant to form agglomerates of different sizes capable of becoming inserted in said matrix.

In a third aspect of the powder mixture of the invention, the second solid lubricant can be selected from tungsten disulfide $WS_2$ or molybdenum disulfide $MoS_2$.

These compounds belong to the dichalcogenide family and have a lamellar hexagonal structure. They react with the matrix-precursor metal alloy to give rise to at least one lubricating phase comprising at least one sulfur compound of hexagonal structure.

For an alloy containing chromium, it has been found, in particular by X-ray diffraction analysis, that a majority self-lubricating phase of chromium sulfide $Cr_7S_8$ is formed. In the particular circumstance of an Astroloy® type alloy, titanium and cobalt alloys also form, but in smaller quantities than $Cr_7S_8$. With an alloy of the TY355® type, chromium and vanadium sulfides form.

The greater the quantity of the second solid lubricant in the mixture, the greater the quantity of hexagonal structure compounds that are formed and the better the self-lubricating properties of the final material.

Concerning the grain size of the second solid lubricant, good results are obtained when it remains below 50 μm.

In the particular circumstance of a mixture including powdered alloy of the Astroloy® type, $CeF_3$ as the first solid lubricant, and $WS_2$ as the second solid lubricant, it has been found, as specified above, that difficulties in sintering and densification become large above 10% by volume of $CeF_3$ in the mixture. Since these difficulties become tangible as from 7%, it can be preferable to keep the content of $CeF_3$ and more generally the content of the first solid lubricant to less than 7% by volume.

It has also been found that above 10% by volume of $WS_2$ in the mixture that difficulties in sintering and densification appear.

The self-lubricating properties of the final solid material can be evaluated by measuring the friction coefficient between said final material and a reference material. These properties become advantageous once the sum of the $CeF_3$ and $WS_2$ contents exceeds 10% by volume, and advantageously 15% by volume.

Thus, good results have been obtained both in terms of sintering and in terms of lubrication, when using a powder mixture including: 5% to 10% or 5% to 7% by volume of $CeF_3$; 5% to 10% by volume of $WS_2$; and in which the sum of the contents of $CeF_3$ plus $WS_2$ exceeds 10% or even 15% by volume.

Furthermore, since the lubricating properties of the first solid lubricant and of the lubricating phase depend on temperature, arrangements can be made to ensure that the temperature ranges over which these lubricating properties are optimized do not overlap. To illustrate this, in the above example, the lubricating properties of the $Cr_7S_8$ phase are optimized at temperatures equal to or less than about 250° C., while the lubricating properties of $CeF_3$ are optimized at temperatures equal to or greater than 250° C. In this way, the solid material made from the powder mixture presents satisfactory self-lubricating properties regardless of the temperature at which it is used.

It is also possible to make arrangements for the self-lubricating properties to be substantially constant over a large range of temperatures, e.g. from 100° C. to 400° C.

Figure 2:
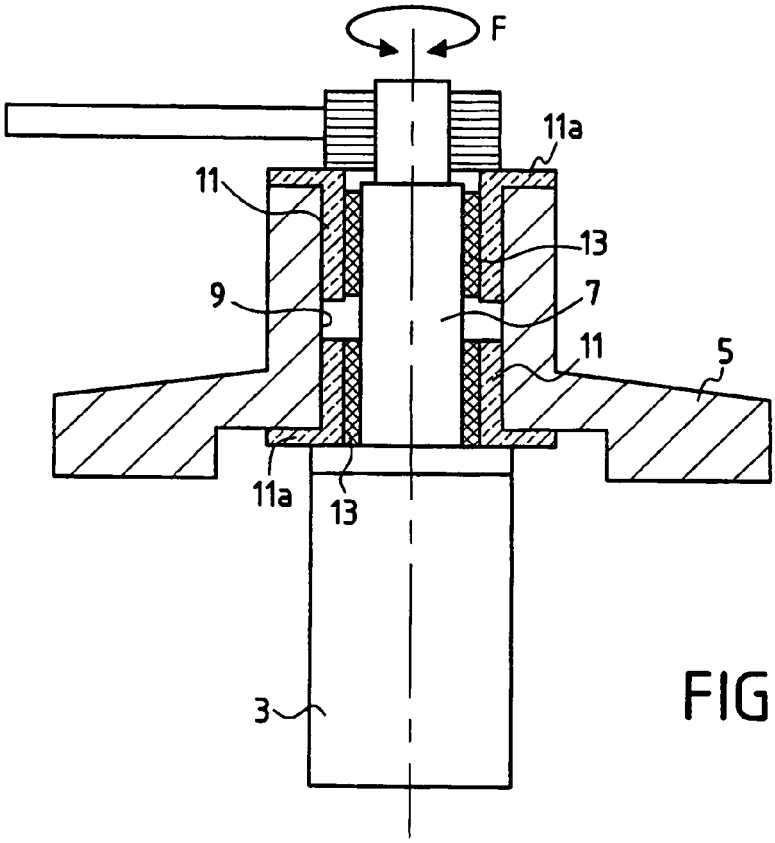

Now that the composition of the powder mixture of the invention and of the self-lubricating material obtained from such a mixture are well understood, there follows a description of an example of a mechanical part that can be made using said material, the description being given with reference to FIGS. 1 and 2.

These figures shows a variable-pitch vane 3 on a stator casing 5 of an airplane turbojet compressor.

The stator vanes 3 are disposed radially at regular intervals inside the casing 5. They are secured to the casing 5 by their roots 7 and they present a certain pitch angle that determines the direction air flows through the compressor. The vanes 3 are said to be of variable pitch since they can be pivoted about their roots 7 so as to vary the pitch angle.

Openings 9 are formed through the casing 5 to receive the blade roots 7, the openings 9 and the roots 7 being cylindrical in shape. To limit friction between each root 7 and the casing 5, bushings 11 made of a self-lubricating solid material of the invention are disposed therebetween.

It is possible to use one or two bushings 11 per opening 9, as shown in the figures. These bushings are mounted as a tight fit in the opening 9 so as to remain secured to the casing 5 even when it expands at high temperature. Each bushing 11 presents a flange 11*a* that surrounds the opening 9 on the inside or outside face of the casing 5.

The bushings 11 seek to protect the casing 5 and the vane roots 7 since it is the bushings that are subjected to wear instead of the other components, and once the bushings 11 have become too worn, they are replaced.

As shown in FIG. 2, it is also possible to place a ring 13 around the root 7 so that the bushing 11 rubs against the ring. The ring 13 is mounted as a tight fit around the root 7 and serves to protect the root.

The friction forces involved in the above assemblies naturally depend on the pairs of materials involved. when the bushing is made of a material complying with the above examples (light alloy matrix of the Astroloy® or TY355® type; $CeF_3$ solid lubricant; and self-lubricating $Cr_7S_8$ phase), the blade roots 7 can be made of a metal alloy based on iron, nickel, or titanium, and the rings 13, if any, can be made of a metal alloy based on iron, nickel, or cobalt.

What is claimed is:

1. A powder mixture suitable for sintering to form a self-lubricating solid material, the mixture comprising:

a metal alloy powder that is a precursor for a matrix of the self-lubricating solid material;

particles of a first solid lubricant comprising cerium trifluoride $CeF_3$; and particles of a second solid lubricant;

wherein:

when the powder mixture is sintered, the first solid lubricant is incorporated into the matrix without reacting with the metal alloy; and when the powder mixture is sintered, the second solid lubricant reacts with a component of the metal alloy to form a lubricating phase.

2. The powder mixture according to claim 1, wherein the first solid lubricant is present in the mixture in an amount of about 15% volume or less.

3. The powder mixture according to claim 2, wherein the first solid lubricant is present in the mixture in an amount of from 5% to 10% by volume.

4. The powder mixture according to claim 1, wherein the second solid lubricant is present in the mixture in an amount of about 15% by volume or less.

5. The powder mixture according to claim 4, wherein the second solid lubricant is present in the mixture in an amount of from 5% to 10% by volume.

6. The powder mixture according to claim 1, wherein the first solid lubricant and the second solid lubricant are present in the mixture in a combined amount of greater than 10% by volume.

7. The powder mixture according to claim 1, wherein the second solid lubricant comprises tungsten disulfide $WS_2$ or molybdenum disulfide $MoS_2$.

8. The powder mixture according to claim 1, wherein the lubricating phase comprises at least one sulfur compound of hexagonal structure.

9. The powder mixture according to claim 1, wherein the metal alloy comprises an alloy based on iron, nickel, or cobalt.

10. The powder mixture according to claim 1, wherein:

the component of the metal alloy is chromium; and the lubricating phase comprises $Cr_7S_8$.

11. The powder mixture according to claim 1, wherein:

the second solid lubricant comprises tungsten disulfide $WS_2$ or molybdenum disulfide $MoS_2$;

the component of the metal alloy is chromium; and the lubricating phase comprises $Cr_7S_8$.

12. A powder mixture according to claim 11, wherein:

the first solid lubricant is present in the mixture in an amount of from 5% to 10% by volume;

the second solid lubricant is present in the mixture lies in an amount of 5% to 10% by volume; and a sum of the amounts of the first and second solid lubricants is greater than 10% by volume.

13. A method of preparing a self-lubricating solid material, comprising:

preparing the powder mixture according to claim 1;

intimately mixing the mixture;

adding a binder to the resulting intimate mixture;

molding the intimate mixture by pressing or injection in a mold to form a blank;

extracting the molded blank from the mold;

evacuating the binder; and densifying the blank by sintering.

14. A self-lubricating solid material, comprising:

a matrix of a metal alloy;

particles of cerium trifluoride $CeF_3$ as a first solid lubricant inserted in said matrix; and a lubricating phase;

wherein:

the particles of the first solid lubricant are present in the matrix but do not react with the metal alloy;

the lubricating phase comprises a reaction product of a second solid lubricant and a component of the metal alloy; and the lubricating phase comprises a sulfur compound of hexagonal structure.

15. The self-lubricating solid material according to claim 14, wherein the metal alloy comprises an alloy based on iron, nickel, or cobalt.

16. The self-lubricating solid material according to claim 14, wherein the sulfur compound of hexagonal structure comprises $Cr_7S_8$.

17. A mechanical part made from the material according to claim 14.

18. The mechanical part according to claim 17, consisting of a bushing for receiving a root of a variable-pitch vane of an airplane turbojet compressor.

* * * * *